US011577262B2

(12) United States Patent
Scheibner et al.

(10) Patent No.: US 11,577,262 B2
(45) Date of Patent: Feb. 14, 2023

(54) NOZZLE ASSEMBLY WITH AUXILIARY APERTURES

(71) Applicant: 3M INNOVATIVE PROPERTIES COMPANY, St. Paul, MN (US)

(72) Inventors: John B. Scheibner, Woodbury, MN (US); Brian E. Duncan, St. Paul, MN (US); Elaine M. Yorkgitis, St. Paul, MN (US); Ryan D. Erickson, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 429 days.

(21) Appl. No.: 15/576,327

(22) PCT Filed: May 20, 2016

(86) PCT No.: PCT/US2016/033415

§ 371 (c)(1),
(2) Date: Nov. 22, 2017

(87) PCT Pub. No.: WO2016/191240

PCT Pub. Date: Dec. 1, 2016

(65) Prior Publication Data

US 2018/0353981 A1 Dec. 13, 2018

Related U.S. Application Data

(60) Provisional application No. 62/166,788, filed on May 27, 2015.

(51) Int. Cl.
*B05B 7/08* (2006.01)
*B05B 7/06* (2006.01)

(52) U.S. Cl.
CPC ..... *B05B 7/0815* (2013.01); *B05B 7/066* (2013.01); *B05B 7/0861* (2013.01)

(58) Field of Classification Search
CPC ..... B05B 7/0815; B05B 7/066; B05B 7/0861
(Continued)

(56) References Cited

U.S. PATENT DOCUMENTS 4,171,096 A 10/1979 Welsh
4,273,293 A 6/1981 Hastings
(Continued)

FOREIGN PATENT DOCUMENTS

JP H9-164345 6/1997
JP 2002-1169 1/2002
(Continued)

OTHER PUBLICATIONS

Carey, Christa; "How Corner Radius Affects CNC Machining" (Year: 2016).*
(Continued)

*Primary Examiner* — Jason J Boeckmann

(57) ABSTRACT

Provided are nozzle assemblies for a spraying apparatus having an outer wall (146) having opposed inner and outer surfaces, a central aperture (136) extending through the outer wall, and a pair of auxiliary apertures (158) disposed on the outer wall (146). Each auxiliary aperture is aligned along a respective auxiliary axis (162) and areas of the inner surface (164) of the outer wall (146) adjacent to the auxiliary apertures (158) are countersunk to define ledges (166) that are axially symmetric about the auxiliary axes (162). These assemblies obviate problems associated with rotatable molding pins and also provide the unexpected advantage of providing axial alignment of the air flow profile as air is emitted from the auxiliary apertures.

16 Claims, 5 Drawing Sheets

(58) Field of Classification Search
USPC ..... 239/601
See application file for complete search history.

(56) References Cited

U.S. PATENT DOCUMENTS

| | | | | |
|---|---|---|---|---|
| 4,957,783 | A | 9/1990 | Gabryszewski | |
| 5,016,820 | A * | 5/1991 | Gaskell | B23H 9/00 239/533.12 |
| 5,209,405 | A * | 5/1993 | Robinson | B05B 7/0081 239/290 |
| 6,494,387 | B1 | 12/2002 | Kaneko | |
| 6,588,681 | B2 | 7/2003 | Rothrum | |
| 6,663,018 | B2 | 12/2003 | Rothrum | |
| 7,188,785 | B2 | 3/2007 | Joseph | |
| 7,201,336 | B2 | 4/2007 | Blette | |
| 7,815,130 | B2 | 10/2010 | Joseph | |
| 8,128,527 | B2 | 3/2012 | Hart | |
| 8,481,124 | B2 * | 7/2013 | Nolte | B05B 7/0815 118/313 |
| 8,632,131 | B2 | 1/2014 | Humbert | |
| 2005/0284957 | A1 | 12/2005 | Haruch | |

FOREIGN PATENT DOCUMENTS

| | | |
|---|---|---|
| JP | 2014-42903 | 3/2014 |
| WO | WO 2010-085801 | 7/2010 |
| WO | WO 2015-084617 | 6/2015 |

OTHER PUBLICATIONS

International search report for PCT International application No. PCT/US2016/033415 dated Aug. 11, 2016, 5 pages.

THIESEL 2002 Conference on Thermo- and Fluid-Dynamic Processes in Diesel Engines, "Nozzle Flow and Spray Characteristics from VCO Diesel Injector Nozzles", pp. 1-13, M. Gavaises, C. Arcoumanis, H. Roth, Y.S. Choi and A. Theodorakakos, Conference Paper Jan. 2004.

* cited by examiner

NOZZLE ASSEMBLY WITH AUXILIARY APERTURES

CROSS REFERENCE TO RELATED APPLICATIONS

This application is a national stage filing under 35 U.S.C. 371 of PCT/US2016/033415, filed May 20, 2016, which claims the benefit of U.S. Provisional Application No. 62/166,788, filed May 27, 2015, the disclosures of which are incorporated by reference in their entireties herein.

FIELD OF THE INVENTION

Provided are nozzle assemblies for a spraying apparatus along with related components, systems and methods. More particularly, the provided nozzle assemblies are for use in handheld spray guns and general spray head assemblies.

BACKGROUND

Spray guns are devices that project a fine mist of particles onto a substrate. For some applications, a pressurized gas, such as air, is used to atomize and direct the particles. Spray guns can be used to apply to a substrate a wide variety of coating media, including primers, paints, clearcoats, slurries, fine powders, and other sprayable fluids. Notable applications for spray guns include painting and texturizing architectural surfaces such as walls and ceilings, furniture finishing, cosmetics, and painting and body repair for marine and automotive exteriors.

Common spray gun configurations use a gun platform that routes compressed air and the liquid to be coated through internal passageways that come together in the vicinity of a spray nozzle. The air and liquid are expelled from the gun through adjacent atomizing and liquid apertures, respectively, comprising the spray nozzle. The fast-moving air flows out of the atomizing apertures through a region of reduced pressure. The air breaks up the liquid from the liquid aperture to form a spray field of fine droplets in a process called atomization. The liquid droplets are propelled toward the surface to be coated.

Before the spray field contacts the substrate, it can be shaped by air jets discharged through precisely positioned orifices (or apertures) in the spray nozzle. These air jets work by re-distributing the spray field proximal to the front face surface of the spray nozzle. Modern spray guns include protruding structures called air horns, which contain one or more pairs of apertures that discharge pressurized air from opposing sides to flatten the spray field, enabling the operator to cover a wider area when applying a coating to a substrate. These spray guns may also include auxiliary air holes, sometimes referred to as "auxiliary apertures" or "secondary apertures," that direct air outwardly from the front face surface of the spray nozzle. Air from the auxiliary apertures can tailor the air jets from the air horns, increase paint flow rate, and help keep the air cap clean.

SUMMARY

Auxiliary apertures, as disclosed in the art, also present certain technical and manufacturing challenges. A first challenge relates to the locations of the auxiliary apertures, which are generally located at flanking positions alongside the atomizing and liquid apertures. Because air must bend around the central passageways that convey the atomizing air and liquid to be sprayed, the air flow behind the auxiliary apertures is subject to a phenomenon called boundary layer separation. As a result, air flow within the auxiliary apertures can separate from the inside edge surfaces, causing air flow to become skewed within the auxiliary apertures. This in turn can adversely affect the distribution of coating media in the final spray pattern. Control over distribution is especially important in high performance spraying applications.

A second challenge relates to mass manufacturing nozzle assemblies through a molding process. Conventionally, auxiliary apertures are drilled into the faceplate (or air cap) of the nozzle assembly and thus have a uniform diameter along their lengths. When molding the nozzle assembly from a thermoplastic polymer, however, molding pins are extended through a mold cavity and molten polymer is injected around the pins to define the auxiliary apertures. Because the outer wall is commonly angled relative to the liquid axis, the molding pin may be asymmetric and precisely registered and rotated to its correct orientation prior to molding. As a result, the process of fabricating, aligning and maintaining the pin is difficult and adds significant cost to the operation.

The provided nozzle assemblies, components, systems, and methods address both problems above by using a modified auxiliary aperture where the opening on the inner surface of the air cap is countersunk into the outer wall. This was found to obviate the problems associated with rotatable molding pins and also provide the unexpected advantage of significantly reducing skew in the air flow profile from the auxiliary apertures. Conventionally, a more uniform air flow profile may be obtained by increasing wall thickness in order to lengthen the auxiliary aperture. Advantageously, the provided modification aligns the resultant air flow profile while keeping the length of the auxiliary apertures as low as possible, reducing weight and materials costs while avoiding the kinds of defects associated with relatively thick walls in molded parts.

In a first aspect, a nozzle assembly for a spraying apparatus is provided. The nozzle assembly comprises: an inner wall having opposed inner and outer surfaces, the inner surface defining a liquid passageway that extends longitudinally along a liquid axis and terminates in a liquid aperture; an outer wall extending around the inner wall and having opposed inner and outer surfaces, wherein the outer surface of the inner wall and inner surface of the outer wall collectively define a first air passageway, the first air passageway terminating in an atomizing aperture adjacent to the liquid aperture; and a pair of auxiliary apertures extending through the outer wall and in communication with the first air passageway, wherein each auxiliary aperture extends along an auxiliary axis and wherein an area of the inner surface of the outer wall adjacent to each auxiliary aperture is countersunk to define a ledge that is axially symmetric about the auxiliary axis.

In a second aspect, a spraying apparatus is provided, comprising: the nozzle assembly as recited above; and a spray gun platform releasably coupled to the nozzle assembly.

In a third aspect, an air cap for a nozzle assembly of a spraying apparatus is provided, the air cap comprising: an outer wall having opposed inner and outer surfaces; a central aperture extending through the outer wall; and a pair of auxiliary apertures disposed on the outer wall, each auxiliary aperture aligned along a respective auxiliary axis, wherein an area of the inner surface of the outer wall adjacent to the auxiliary aperture is countersunk to define a ledge that is axially symmetric about the auxiliary axis.

In a fourth aspect, a method of aligning auxiliary air flow through the nozzle assembly as recited above is provided.

The method comprises: discharging a liquid from the liquid aperture in a conical stream of liquid droplets while simultaneously directing air from the fan control apertures against the discharged liquid from opposing directions to flatten the conical stream of liquid droplets; and directing air from the pair of auxiliary apertures to modify the air flowing from the fan control apertures, wherein each ledge improves axial alignment of the air flow external to its respective auxiliary aperture.

In a fifth aspect, a method of making the air cap as recited above from mating core and cavity members is provided, the method comprising: incorporating into either the core or cavity member a pair of cylindrical pins, each having an annular ledge extending along its circumference, the annular ledge having a shape that is complemental to a corresponding ledge on the inner surface of the outer wall; bringing the core and cavity members together in opposing relation to define a mold cavity, wherein a distal end of each cylindrical pin engages an opposing member; and introducing a molten polymer into the mold cavity to form the air cap with each auxiliary aperture defined as an inverse of a respective cylindrical pin, followed by cooling and hardening the polymer melt and releasing the air cap from the mold.

BRIEF DESCRIPTION OF THE DRAWINGS

Exemplary embodiments shall be further described with reference to the following drawings.

DEFINITIONS

Figure 1:
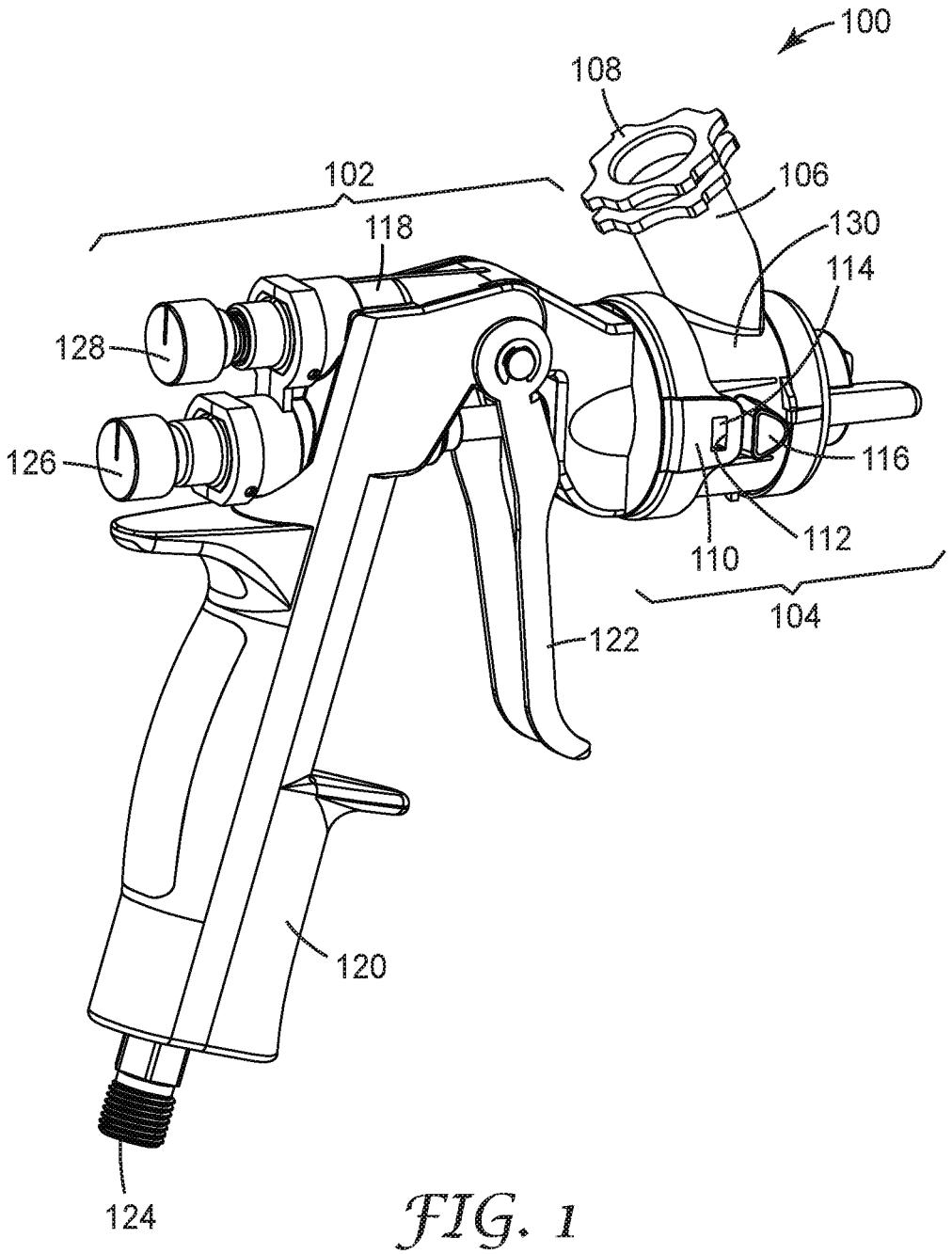
FIG. 1 is a perspective view of a spraying apparatus according to an exemplary embodiment, showing its side, rear, and top surfaces.

As used herein:

"Pressurized gas" refers to gas under greater than atmospheric pressure.

DETAILED DESCRIPTION

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

Described herein are articles, assemblies, and related methods relevant to making and using spray guns. Such spray guns include, for example, high volume low pressure spray guns used in automotive, decorative, marine, architectural coating, furniture finishing, scenic painting and cosmetic industries.

A spraying apparatus according to one exemplary embodiment is illustrated in FIG. 1 and designated by the numeral 100. The spraying apparatus 100 includes a spray gun platform 102 and a nozzle assembly 104 operatively coupled to the spray gun platform 102. Optionally and as shown, the nozzle assembly 104 is releasably connected to the spray gun platform 102, allowing the former to be conveniently detached and cleaned. In a preferred embodiment, the nozzle assembly 104 is made from plastic and may be discarded or cleaned and re-used at the end of a spraying operation. As a further option, the nozzle assembly 104 and spray gun platform 102 may be combined as an integral unit.

Extending outwardly from the top of the nozzle assembly 104 is a liquid inlet 106 having a distal end 108. Preferably, the distal end 108 has a configuration adapted to releasably connect the liquid inlet 106 to a liquid container (not shown). The spraying apparatus 100, as shown, is of the gravity-fed type in which the liquid container is located above the spray gun platform 102 to facilitate gravitational flow of the liquid to be sprayed into the nozzle assembly 104. The spraying apparatus 100 need not be gravity-fed. For example, the liquid inlet 106 can be connected to a fluid source that is pressurized so that the fluid can be fed from below or any other location.

Exemplary liquid containers are previously described, for example, in U.S. Pat. No. 6,588,681 (Rothrum et al.), U.S. Pat. No. 6,663,018 (Rothrum et al.), U.S. Pat. No. 7,188,785 (Joseph et al.), U.S. Pat. No. 7,815,130 (Joseph et al.), and provisional U.S. Patent Application No. 61/912,038 (Nyaribo et al.), filed on Dec. 5, 2013.

In FIG. 1, and as described in published International Application No. WO 2010/085801 (Escoto et al.), the liquid inlet 106 is itself incorporated into the nozzle assembly 104. Advantageously, this avoids the need for extensive cleaning of the spray gun platform 102 between spraying operations.

The connecting interface between the nozzle assembly 104 and the spray gun platform 102 enables fluid communication between the interior cavities of these components. Any attachment mechanism known in the art can serve this purpose.

In the side view shown in FIG. 1, the spray gun platform 102 and nozzle assembly 104 are interconnected by an interference fit. The former includes a pair of connection tabs 110 having respective rectangular openings 112 that snugly engage projections 114 located on a barrel 130 of the nozzle assembly 104. When the spray gun platform 102 and nozzle assembly 104 are connected to each other, the projections 114 on the nozzle assembly 104 flex inwardly to snap into the openings 112.

To detach the nozzle assembly 104, the operator pinching buttons 116 in directions toward each other to depress the projections 114 and disengage them from the connection tabs 110. Locking engagement between the openings 112 and the retaining projections 114 prevents the nozzle assembly 104 from becoming inadvertently detached. Alternatively or in combination, other mechanisms can be used, including bayonet-type fixtures, clamps, collars, magnets, and mating threaded connections.

Referring again to FIG. 1, the spray gun platform 102 includes a frame 118, and a pistol-grip handle 120 and trigger 122 connected to the frame 118. Extending outwardly from the bottom of the handle 120 is a threaded air inlet port 124 for connection to a suitable source of pressurized gas, typically air. Optionally and as shown, the trigger 122 is pivotally connected to the frame 118 and biased toward its forward-most position.

Optionally, a fluid control regulator 126 and fan control regulator 128 can be built into the rear-facing surface of the frame 118 to adjust the rate the coating liquid is dispensed from the nozzle assembly 104 and the pressure of gas flowing from the spray gun platform 102 into the nozzle assembly 104. In this exemplary embodiment, the fan control regulator 128 is a rotatable knob that allows an operator to control air flow to a pair of air horns used to adjust the spray pattern geometry. The fluid control regulator 126, by contrast, adjusts the longitudinal travel distance of a fluid needle associated with a needle valve (not visible) located within the spraying apparatus 100. The travel of the fluid needle can affect both fluid flow and air flow. Depressing the trigger 122 actuates the needle valve and dispenses the coating liquid from the spraying apparatus 100.

These features, and others, are further described in International Application No. WO 2010/085801 (Escoto et al.).

Figure 2:
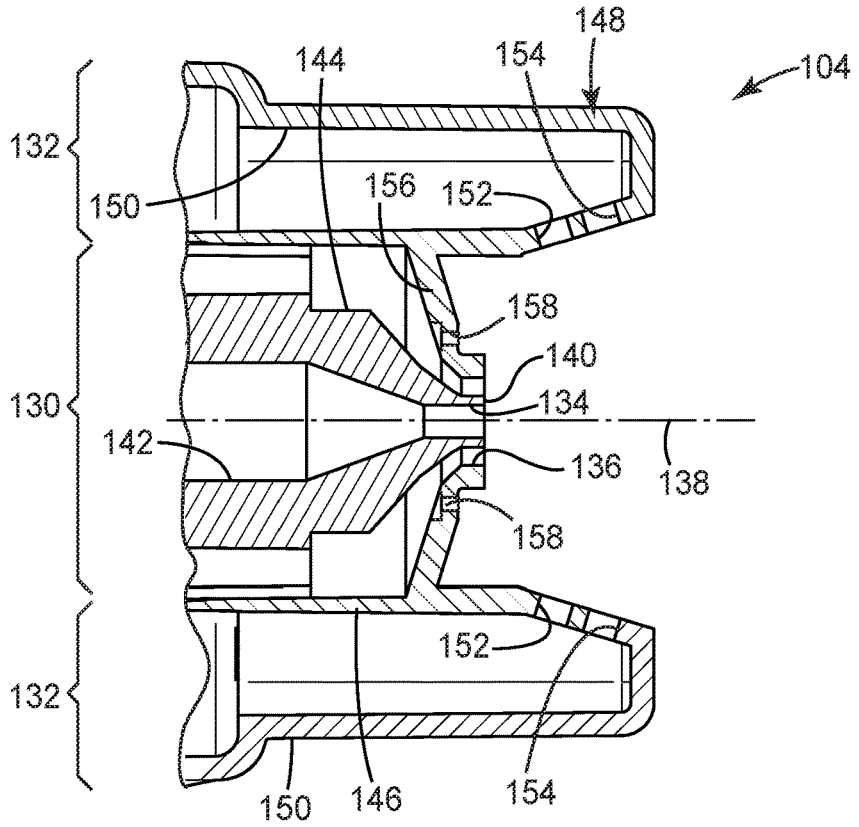
FIG. 2 is a fragmentary cross-sectional side view of a nozzle assembly of the spraying apparatus of FIG. 1.
Figure 3:
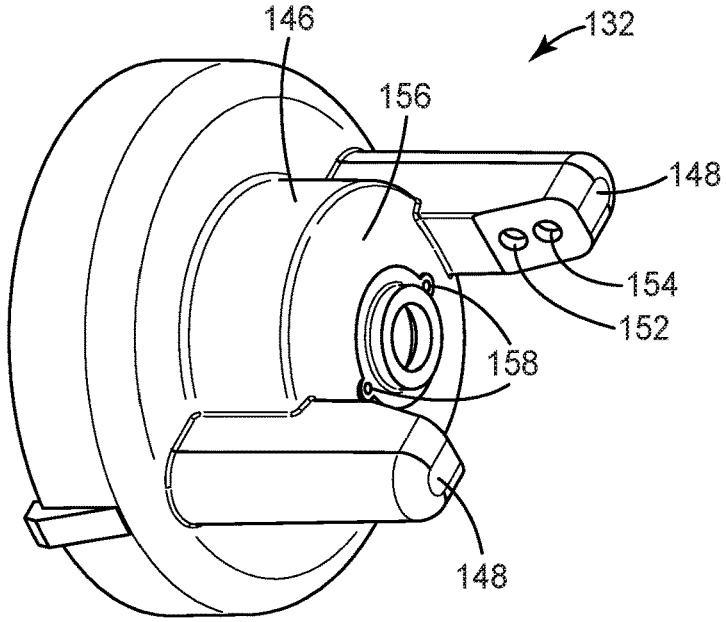
FIG. 3 is a perspective view of an air cap of the nozzle assembly of FIG. 2, showing its front and side surfaces.

FIGS. 2 and 3 provide alternative views showing features of the nozzle assembly 104 and its components in more detail. As shown, the nozzle assembly 104 includes the barrel 130 and an air cap 132 engaged to the front, or working end, of the barrel 130. Optionally and as shown, the air cap 132 is rotatably coupled to the working end of the barrel 130 in encircling relation, permitting a 90-degree range of relative rotation between these components. In a simplified alternative, the air cap 132 could be fixed relative to the barrel 130 or even formed as an integral component of the barrel 130.

Centrally disposed on the front surface of the nozzle assembly 104 are a pair of concentric apertures: a circular liquid aperture 134 and an annular atomizing aperture 136 adjacent to, and surrounding, the liquid aperture 134. The apertures 134, 136 are separated by a generally cylindrical inner wall 140 of the barrel 130. In this exemplary embodiment, each of the apertures 134, 136 and inner wall 140 are concentrically disposed about a liquid axis 138, shown in FIGS. 2 and 4. The apertures may vary in shape, size, and relative orientation from that depicted here. For example, the atomizing aperture 136 need not be annular and may only partially surround the liquid aperture 134. Further, two or more liquid apertures 134 or atomizing apertures 136 could be implemented if so desired.

The basic principle of operation of the spraying apparatus 100 can be described with reference to the cross-sectional view shown in FIG. 2. As illustrated, a liquid passageway 142, defined by inner surfaces of the inner wall 140, and a first air passageway 144, defined by the annular space between the inner wall 140 and an outer wall 146 of the air cap 132, extend longitudinally along the liquid axis 138. The liquid passageway 142 and first air passageway 144 initiate at the rear end of the nozzle assembly 104 and terminate at the liquid aperture 134 and atomizing aperture 136, respectively.

Optionally and as shown, the passageways 142, 144 have volumetric shapes generally symmetric about the liquid axis 138 in the vicinity of the apertures 134, 136. The outer wall 146 of the air cap 132, whose exterior surface is visible in FIG. 3, extends around the inner wall 140 and defines outermost surfaces of the first air passageway 144. The outer wall 146 is cylindrically shaped in this embodiment, although other shapes are also possible.

When the trigger 122 is depressed, air is injected under pressure through the rear end of the nozzle assembly 104 and accelerates as it enters regions of decreasing cross-section before being expelled from the atomizing aperture 136. Based on the Venturi effect, this results in a pressure drop in front of the liquid aperture 134, which can help draw fluid to be sprayed out of the liquid passageway 142 and through the liquid aperture 134. Upon encountering the moving air, the coating fluid is then atomized—that is, pulverized into many fine droplets. In parallel, the liquid may also be urged through the liquid aperture 134 by gravity or by pressurizing the liquid within the liquid container.

Referring again to FIGS. 2-4, a pair of air horns 148 extend outwardly in the forward direction from the air cap 132 and protrude past both the liquid aperture 134 and atomizing aperture 136. In this embodiment, the air horns 148 are integrally formed as part of the air cap 132, standing as mirror images of each other on opposite sides of the liquid axis 138. Each air horn 148 defines a respective air horn cavity in communication with a second air passageway 150 that terminates in a generally circular inner fan control aperture 152 and adjacent outer fan control aperture 154. The fan control apertures 152, 154 extend through the external surface of the air horn 148 and serve to discharge pressurized air from the second air passageway 150. Optionally, only one fan control aperture may be present on each air horn 148. As a further option, either or both of the fan control apertures 152, 154 may assume non-circular shapes, as described in U.S. Pat. No. 7,201,336 (Blette et al.).

During operation of the spraying apparatus 100, where a fluid stream is being discharged from the liquid aperture 134, the air horns 148 enable simultaneous air flow from the fan control apertures 152, 154 against the fluid stream from opposing directions to flatten the airborne spray profile and improve operator control over the resulting spray pattern.

In some embodiments, the air pressure driving the flow of air from the fan control apertures 152, 154 is independently regulated from the air pressure used to atomize the fluid to be dispensed from the spraying apparatus 100. For example, this can be achieved when the atomizing aperture 136 and fan control apertures 152, 154 are isolated from each other within the nozzle assembly 104. This can be achieved using discrete first and second air passageways 144, 150 having internal air pressures that are independently regulated, thus allowing a pressure differential to be maintained between them.

In an alternative configuration, the same volume of pressurized air can be used for both of the functions above; for example, the first and second air passageways 144, 150 can be in communication with each other within the nozzle assembly 104. For example, both of the first and second air passageways 144, 150 could communicate with a common plenum adjacent to the interface between the spray gun platform 102 and nozzle assembly 104. In this configuration the first and second air passageways 144, 150 would be in fluid communication, enabling both passageways 144, 150 to be pressurized using a single conduit on the spray gun platform 102. The apportionment of air flowing into the nozzle assembly 104 can also be controlled, at least in part, by the geometry of the first and second air passageways 144, 150.

As further shown in FIGS. 1-2, the outer wall 146 includes a front-facing wall section 156. Extending through the wall section 156 is a pair of auxiliary apertures 158 flanking the liquid aperture 134 and atomizing aperture 136. The auxiliary apertures 158 are diametrically opposed with respect to the liquid axis 138 and are aligned such that they are coplanar with the fan control apertures 152, 154 of respective air horns 148. Optionally, the auxiliary apertures 158 could be slightly out of plane yet sufficiently close to influence the shaping air jets emitted from the fan control apertures 152, 154.

Figure 4:
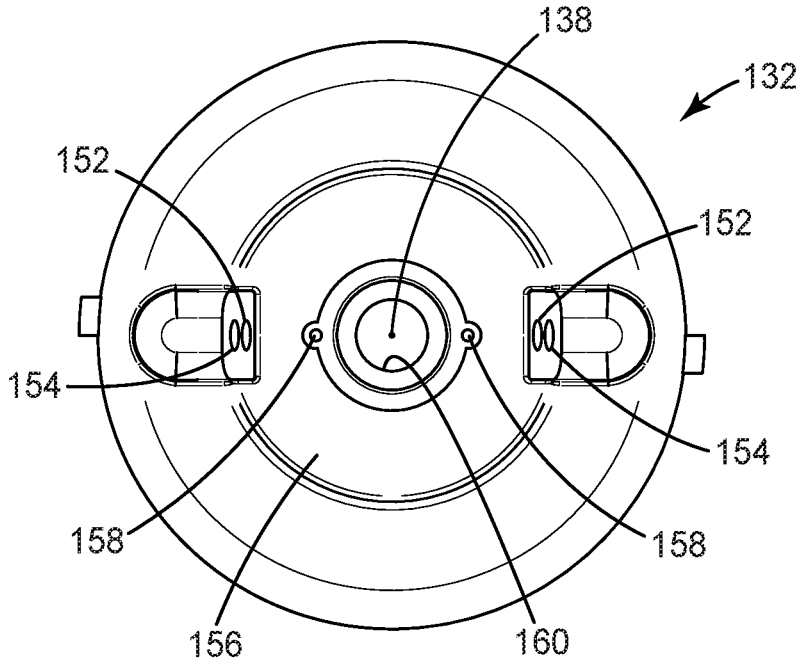
FIG. 4 is an elevational front view of the air cap of FIG. 3, showing its front surface.
Figure 5:
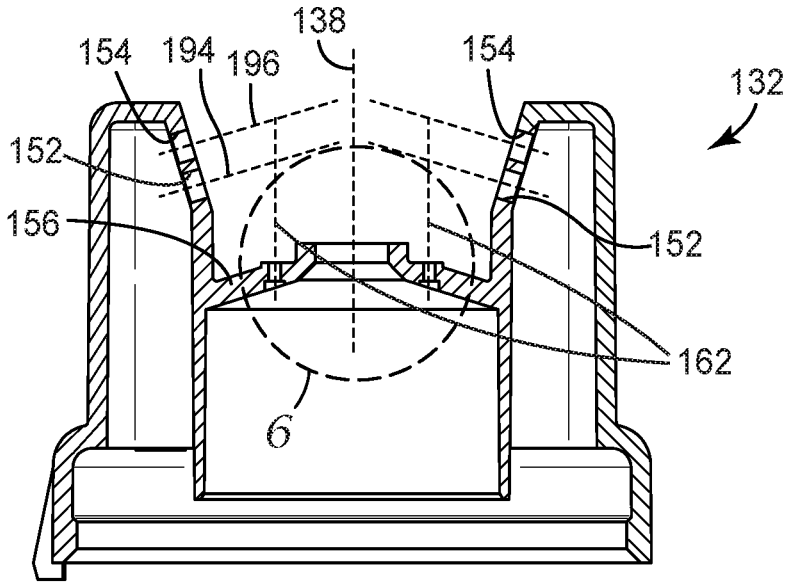
FIG. 5 is a side cross-sectional view of the air cap of FIGS. 3-4.
Figure 6:
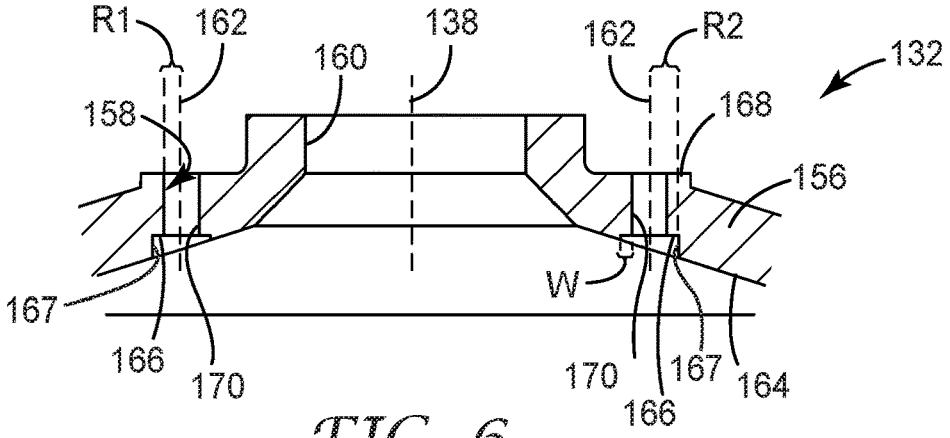
FIG. 6 is an enlarged fragmentary cross-sectional view of the air cap of FIGS. 3-5 corresponding to inset 6 shown in FIG. 5.

For clarity, further aspects concerning the auxiliary apertures 158 will now be described with respect to views of the air cap 132 as detached from the rest of the nozzle assembly 104. In FIGS. 4-6, the air cap 132 is shown having a central aperture 160 disposed in its wall section 156. The edges of the central aperture 160 define the circumferential outer edge of the atomizing aperture 136 when the nozzle assembly 104 is assembled.

As depicted in FIG. 5, the auxiliary apertures 158 are aligned with respective auxiliary axes 162, while the fan control apertures 152, 154 are aligned with respective fan control axes 194, 196. Optionally and as shown here, the auxiliary axes 162 intersect with the fan control axes 194, 196 and extend along directions transverse to those of the fan control axes 194, 196. In a preferred embodiment, the auxiliary axes 162 extend in directions parallel to the liquid axis 138. If desired, however, the auxiliary axes 162 may be angled slightly from the liquid axis 138.

Referring now to FIG. 6, an inner surface 164 of the wall section 156 adjacent to the entrance of each auxiliary aperture 158 is countersunk to define a ledge 166. In this particular embodiment, each ledge 166 has an annular shape that is axially symmetric about the auxiliary axis 162 of its respective auxiliary aperture 158. In the embodiment shown, each ledge 166 is generally planar and extends along a plane that is perpendicular to the respective auxiliary axis 162. Optionally but not shown, the ledges 166 may be somewhat angled relative to the auxiliary axis 162, such angle being at least 45 degrees, at least 55 degrees, at least 65 degrees, at least 75 degrees, at least 80 degrees, or at least 85 degrees. In one such variant, for example, the ledges 166 coincide with a conical, rather than a planar, surface.

More generally, each ledge 166 represents a portion of the inner surface 164 that bridges a cylindrical side wall 170 of the auxiliary aperture 158 (characterized by a certain radius R1) with the peripheral surface 167 of a cavity adjacent to the auxiliary aperture 158. The peripheral surface 167 generally revolves about, and is coaxial with, the auxiliary axis 162 and characterized by an enlarged radius R2, where R2 is greater than R1. Notably, the ledge 166 could be planar, convex, or concave, and have any of a number of angular orientations relative to the auxiliary axis 162.

While not shown here, it is possible for the auxiliary apertures 158 to have side walls that are not cylindrical. For example, the corresponding side walls 170 could have a tapered or a truncated conical configuration.

The shapes of the ledges 166 can be wholly or partially curved, for example, where the entrances to the auxiliary apertures 158 are manufactured with a significant corner radius. In some embodiments, each auxiliary aperture 158 has an annular edge defined at the interface between the side wall 170 and the ledge 166, the annular edge having a corner radius of at least 1 percent, at least 2 percent, at least 4 percent, at least 6 percent, or at least 8 percent of the radius R1. In the same or alternative embodiments, the annular edge has a corner radius of at most 25 percent, at most 50 percent, at most 75 percent, at most 150 percent, or at most 300 percent of the radius R1. For the purposes of this disclosure, the annular edge extends along the geometric center of the convex areas associated with the corner radius above.

The characteristics of the auxiliary apertures 158 (e.g. diameter) and the relative angular orientation between the inner surface 164 and the auxiliary axis 162 may significantly differ from those shown in FIG. 6, the corresponding ledge 166 need not have an annular shape. For example, if the deviation between the auxiliary axis 162 and the normal to the inner surface 164 is sufficiently large, then the ledge 166 could become crescent-shaped instead of annular. Even in this case, however, the surface of such a ledge 166 is preferably inscribed within an annular ring having axial symmetry about the auxiliary axis 162.

In FIG. 6, each ledge 166 has a certain maximum width W, as measured along a radial direction perpendicular to the auxiliary axis 162. In this particular embodiment, maximum width W can also be represented as the difference between R1 and R2 (i.e., R2-R1). The maximum width W, in some embodiments, can be at least 10 percent, at least 20 percent, at least 30 percent, at least 40 percent, or at least 50 percent of the radius R1 of the auxiliary aperture 158. In some embodiments, the maximum width W can be at most 70 percent, at most 90 percent, at most 110 percent, at most 130 percent, at most 150 percent, or at most 300 percent of the radius R1.

In the exemplary embodiment of FIG. 6, the exit of each auxiliary aperture 158 is located on an area of an outer surface 168 of the wall section 156 that is generally planar and oriented perpendicular to the auxiliary axis 162. Because both the inner surface 164 and outer surface 168 of the wall section 156 are perpendicular to the auxiliary axis 162, the side wall 170 of the auxiliary aperture 158 has an axial length that is generally constant along its circumference. This need not be the case, however, particularly if the auxiliary aperture 158 is angled to some extent relative to the wall section 156.

To facilitate the manufacturing of the air cap 132, a suitable corner radius may be implemented between each ledge 166 and its adjacent side wall 170. While such a corner radius narrows the annular ledge 166, this was not found to compromise the performance of the nozzle assembly 104 when used in the spraying apparatus 100.

Areas of the inner surface 164 of the wall section 156 outside the perimeter of the ledges 166 have a generally conical shape symmetric about the liquid axis 138.

When operating the spraying apparatus 100, pulling back on the trigger 122 injects air and liquid into the first air passageway 144 and the liquid passageway 142, respectively. As described previously, the liquid flows from the liquid aperture 134 and is atomized by fast moving air discharged from the atomizing aperture 136 and propelled away from both apertures 134, 136 in a conical stream of liquid droplets. Simultaneously, air from the fan control apertures 152, 154 is directed against the stream of liquid droplets from opposing directions to flatten the conical stream of liquid droplets before the droplets come into contact with the substrate.

Simultaneously with the above, air is discharged from the auxiliary apertures 158 to modify the air flow profile in the vicinity of the apertures 134, 136. Air emitted from the auxiliary apertures 158 interacts with the air emitted from the fan control apertures 152, 154 to flatten and re-distribute the atomized spray field.

The ledges 166 present on the inner surface 164 of the nozzle assembly 104 were discovered to provide important technical advantages.

Figure 7A:
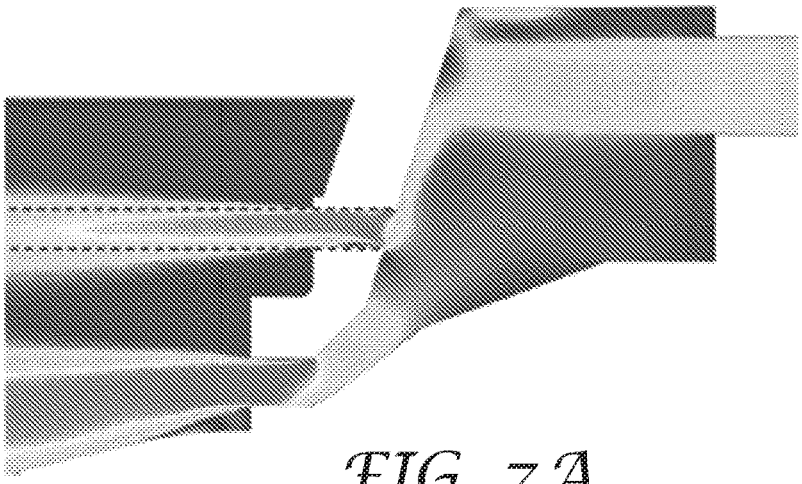
FIGS. 7A and 7B are contour images showing simulated air velocity profiles for a conventional nozzle assembly and the provided nozzle assembly of FIGS. 2-6, respectively.
Figure 7B:
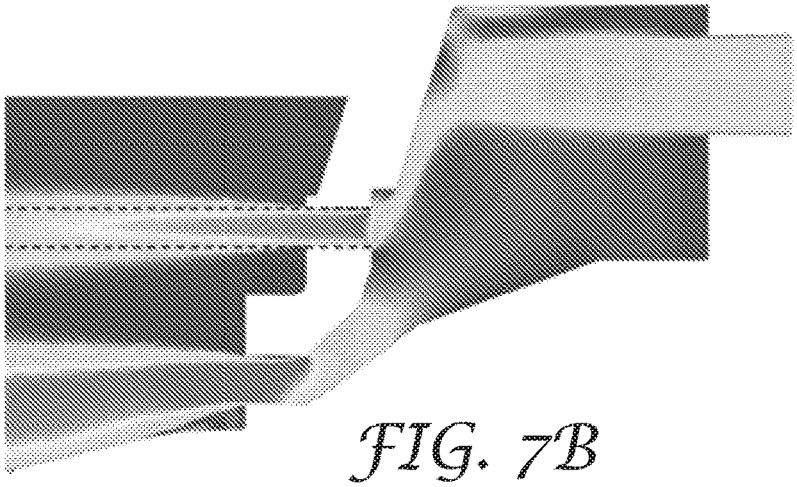

First, this configuration improves axial alignment of the air flow both through the auxiliary apertures 158 and external to the air cap 132 compared with analogous configurations of the nozzle assembly 104 that are missing the ledges 166. This improvement is evident in FIGS. 7A and 7B, showing simulated air flow profiles of a conventional nozzle assembly and one including the ledges 166 as described in the Examples section below.

While such axial alignment could be achieved by lengthening the auxiliary apertures 158, this would require increasing the thickness of the wall section 156, leading to an unnecessary increase in the cost and weight of the nozzle assembly 104.

Figure 8:
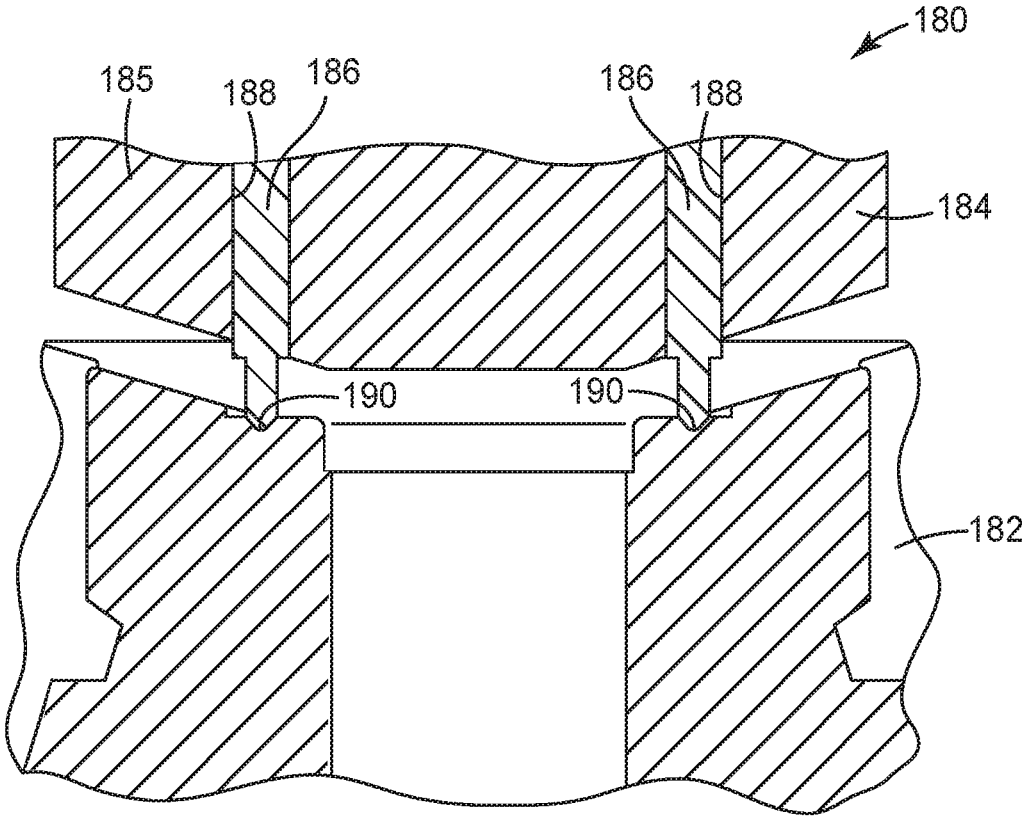
FIG. 8 shows an exemplary molding apparatus for manufacturing the air cap of FIGS. 3-6.

Second, the symmetry of the ledges 166 about the auxiliary axes 162 significantly facilitates fabrication of the air cap 132 in a thermoplastic molding process. This is demonstrated by FIG. 8, which shows an exemplary molding assembly 180. The molding assembly 180 is comprised of a cavity member 182 and a mating core member 184. The core member 184 includes a main body 185 and a pair of pins 186 slidably received in respective guide holes 188 extending through the main body 185. The ends of the pins 186 act as mold shut-offs and are received in pilot features 190. The pilot features 190, as shown, are blind holes have configurations that mate with the distal ends of the pins 186.

When the core member 184 and cavity member 182 are engaged as shown and molten polymer is introduced into the space therebetween to form the air cap, the pins 186 define the shapes of the auxiliary apertures 158 and ledges 166. Advantageously, there is no need to key each pin 186 from the core member 184 to fit into the cavity member 182. The pins 186 can thus adopt any orientation within the guide holes 188 provided that their distal ends abut against the pilot features 190.

Optionally, the distal ends of the pins 186 are tapered to present respective sloping side walls. The sloping side wall may have any particular angle that helps guide the distal ends into their corresponding pilot features 190. In some embodiments, the sloping side wall is oriented at an angle ranging from 40 to 50 degrees with respect to the longitudinal axis of its respective cylindrical pin 186.

As an alternative, a butt shut-off configuration may be used where the pins 186 are pressed against opposing surfaces of the cavity member 182 without need for a pilot feature.

Once the molten polymer has sufficiently hardened in the space between the cavity member 182 and the core member 184, these components can be pulled apart from each other and the air cap released.

Any of the mold surfaces described herein may optionally have drafts of a few degrees incorporated to facilitate removal of parts from the mold.

As previously mentioned, the foregoing fabrication process can also mitigate defects that arise from molding thick walled parts, such as shrinkage-related defects.

While not intended to be limiting, particular exemplary spraying apparatuses, nozzle assemblies, air caps, along with methods of making and use thereof, are enumerated as follows:

1. A nozzle assembly for a spraying apparatus including:

an inner wall having opposed inner and outer surfaces, the inner surface defining a liquid passageway that extends longitudinally along a liquid axis and terminates in a liquid aperture;

an outer wall extending around the inner wall and having opposed inner and outer surfaces, wherein the outer surface of the inner wall and inner surface of the outer wall collectively define a first air passageway, the first air passageway terminating in an atomizing aperture adjacent the liquid aperture; and a pair of auxiliary apertures extending through the outer wall and in communication with the first air passageway, wherein each auxiliary aperture extends along an auxiliary axis and wherein an area of the inner surface of the outer wall adjacent to each auxiliary aperture is countersunk to define a ledge that is axially symmetric about its auxiliary axis.

2. The nozzle assembly of embodiment 1, wherein each auxiliary aperture has a cylindrical side wall whose length, defined along its longitudinal axis, is generally constant along the circumference of the auxiliary aperture.

3. The nozzle assembly of embodiment 1 or 2, further including a pair of diametrically opposed air horns protruding past the liquid aperture from the outer wall and defining respective air horn cavities in communication with a second air passageway, each air horn having an external wall and at least one fan control aperture extending along a fan control axis through the external wall to direct air from the air horn cavity against a stream of liquid droplets discharged from the liquid aperture, each auxiliary axis aligned transverse to a respective fan control axis.

4. The nozzle assembly of any one of embodiments 1-3, wherein the ledge is generally planar and aligned along a reference plane.

5. The nozzle assembly of embodiment 4, wherein the reference plane is oriented at an angle relative to the liquid axis, the angle ranging from 90 degrees to 45 degrees.

6. The nozzle assembly of embodiment 5, wherein the angle is approximately 90 degrees.

7. The nozzle assembly of any one of embodiments 1-6, wherein the ledge is generally crescent-shaped.

8. The nozzle assembly of any one of embodiments 1-6, wherein the ledge has an annular shape.

9. The nozzle assembly of any one of embodiments 1-8, wherein each auxiliary aperture has a certain radius and the ledge has a certain maximum width as measured along a radial direction perpendicular to the auxiliary axis, the certain maximum width ranging from 10 percent to 300 percent of the certain radius.

10. The nozzle assembly of embodiment 9, wherein the certain maximum width ranges from 30 percent to 110 percent of the certain radius.

11. The nozzle assembly of embodiment 10, wherein the certain maximum width ranges from 50 percent to 70 percent of the certain radius.

12. The nozzle assembly of embodiment 11, wherein each auxiliary aperture extends through a portion of the outer surface of the outer wall that is generally planar and has an orientation perpendicular to the liquid axis.

13. The nozzle assembly of any one of embodiments 1-12, wherein each auxiliary aperture has an annular edge defined along the area of the inner surface of the outer wall, the annular edge having a corner radius ranging from 1 percent to 300 percent of the radius of the auxiliary aperture.

14. The nozzle assembly of embodiment 13, wherein the annular edge has a corner radius ranging from 4 percent to 75 percent of the radius of the auxiliary aperture.

15. The nozzle assembly of embodiment 14, wherein the annular edge has a corner radius ranging from 8 percent to 25 percent of the radius of the auxiliary aperture.

16. The nozzle assembly of any one of embodiments 1-15, wherein the pair of auxiliary apertures is a first pair and further including one or more additional pairs of auxiliary apertures extending through the outer wall and each having substantially the same features as the first pair.

17. A method of aligning auxiliary air flow through the nozzle assembly of embodiment 3, the method including:

discharging a liquid from the liquid aperture in a conical stream of liquid droplets while directing air from the fan control apertures against the discharged liquid from opposing directions to flatten the conical stream of liquid droplets; and directing air from the pair of auxiliary apertures to modify the air flowing from the fan control apertures, wherein each ledge improves axial alignment of the air flow external to its respective auxiliary aperture.

18. The method of embodiment 17, wherein air flowing into each auxiliary aperture is directed along directions parallel to the inner surface of the outer wall.

19. The method of embodiment 17 or 18, wherein the air discharged from each auxiliary aperture has a flow field that is generally symmetric about its respective auxiliary axis.

20. A spraying apparatus including:

the nozzle assembly of any one of embodiments 1-16; and a spray gun platform releasably coupled to the nozzle assembly.

21. An air cap for a nozzle assembly of a spraying apparatus including:

an outer wall having opposed inner and outer surfaces;

a central aperture extending through the outer wall; and a pair of auxiliary apertures disposed on the outer wall, each auxiliary aperture aligned along a respective auxiliary axis, wherein an area of the inner surface of the outer wall adjacent to the auxiliary aperture is countersunk to define a ledge that is axially symmetric about the auxiliary axis.

22. The air cap of embodiment 21, further including a pair of diametrically opposed air horns protruding from the outer wall past the central aperture and defining respective air horn cavities, each air horn having an external wall and a fan control aperture extending along a fan control axis through the external wall to direct air from the air horn cavity against a conical stream of liquid droplets discharged from the central aperture, wherein each auxiliary axis is oriented transverse to a respective fan control axis.

23. A method of making the air cap of embodiment 21 or 22 from mating core and cavity members, including:

incorporating into either the core or cavity member a pair of cylindrical pins, each having an annular ledge extending along its circumference, the annular ledge having a shape that is complemental to a corresponding ledge on the inner surface of the outer wall;

bringing the core and cavity members together in opposing relation to define a mold cavity, wherein a distal end of each cylindrical pin contacts an opposing member in mating relation; and introducing a molten polymer into the mold cavity to form the air cap with each auxiliary aperture defined as an inverse of a respective cylindrical pin.

24. The method of embodiment 23, wherein each cylindrical pin is removably received in the core or cavity member.

25. The method of embodiment 23 or 24, wherein the distal end is tapered to present a sloping side wall.

26. The method of embodiment 25, wherein the sloping side wall is oriented at an angle ranging from about 40 to 50 degrees with respect to the longitudinal axis of the cylindrical pin.

27. The method of any one of embodiments 23-26, wherein the distal end of each cylindrical pin engages a pilot hole on the opposing member, the pilot hole being a blind hole.

Objects and advantages of this disclosure are further illustrated by the following non-limiting Example.

EXAMPLE

Two three-dimensional models of nozzle assemblies having auxiliary apertures were generated, an Example and a Comparative. The Example is based on the geometry shown in FIG. 7A and used an auxiliary aperture diameter of 0.030 inches (0.75 millimeters). The Comparative is based on the geometry shown in FIG. 7B, which was essentially the same except for the absence of countersunk ledges—i.e., areas of the inner surface immediately adjacent to each auxiliary aperture were not countersunk but rather flush with the conical inner surface of the outer wall.

A Computational Fluid Dynamics (CFD) software package, FLUENT (available from ANSYS, Inc., Canonsburg, Pa.), was used to carry out calculations. The model was implemented to predict air flow behavior within the system. Compressibility effects of the gas were included in the model.

This model contained approximately 7 million cells. Within FLUENT, the "Pressure-Based Coupled Solver" was used along with the pseudo-transient solution method and was found to enable a steady state solution with good stability. The turbulence model used was the Realizable K-e model with enhanced wall treatment. Boundary conditions for the domain are given in Table 1. Flow rates for shaping air passages were set to approximately 50% of total air flow. Boundary conditions remain constant for each model, so that the only modification made between models shows the effect of geometry changes.

TABLE 1

Model Boundary Conditions

| Boundary | Total Pressure (psig) | Mass Flow Rate (g/s) | Turbulence Intensity (%) | Integral Length Scale (m) |
|---|---|---|---|---|
| Nozzle Pressure Inlet | 10.3 | — | 3 | 0.001 |
| Domain Outlets | 0 | — | 30 | 0.01 |
| Shaping Air Horn | — | 1.872 | 3 | 0.001 |

Contour images corresponding to the Example and the Comparative are shown in FIGS. 7A and 7B, respectively. As shown, the inclusion of the countersunk ledges adjacent to the auxiliary apertures resulted in improved axial alignment of the air flow both within the auxiliary apertures and in the space in front of the auxiliary apertures.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A nozzle assembly for a spraying apparatus comprising:

an inner wall having opposed inner and outer surfaces, the inner surface defining a liquid passageway that extends longitudinally along a liquid axis and terminates in a liquid aperture;

an outer wall extending around the inner wall and having opposed inner and outer surfaces, wherein the outer surface of the inner wall and inner surface of the outer wall collectively define a first air passageway, the first air passageway terminating in an atomizing aperture adjacent the liquid aperture;

a pair of auxiliary apertures extending through the outer wall and in communication with the first air passageway, wherein each auxiliary aperture extends along an auxiliary axis and wherein an area of the inner surface of the outer wall adjacent to each auxiliary aperture is countersunk to define a ledge that is axially symmetric about its auxiliary axis; and a pair of diametrically opposed air horns protruding past the liquid aperture from the outer wall and defining respective air horn cavities in communication with a second air passageway, each air horn having an external wall and a fan control aperture extending along a fan control axis through the external wall to direct air from the air horn cavity against a stream of liquid droplets discharged from the liquid aperture, each auxiliary axis aligned transverse to a respective fan control axis.

2. The nozzle assembly of claim 1, wherein each auxiliary aperture has a cylindrical side wall whose length, defined along its longitudinal axis, is generally constant along the circumference of the auxiliary aperture.

3. The nozzle assembly of claim 1, wherein the ledge is generally planar and aligned along a reference plane.

4. The nozzle assembly of claim 1, wherein each auxiliary aperture has a certain radius and the ledge has a certain maximum width as measured along a radial direction perpendicular to the auxiliary axis, the certain maximum width ranging from 10 percent to 300 percent of the certain radius.

5. The nozzle assembly of claim 1, wherein the pair of auxiliary apertures is a first pair and further comprising one or more additional pairs of auxiliary apertures extending through the outer wall and each having substantially the same features as the first pair.

6. A method of aligning auxiliary air flow through the nozzle assembly of claim 1, the method comprising:

discharging a liquid from the liquid aperture in a conical stream of liquid droplets while directing air from the fan control apertures against the discharged liquid from opposing directions to flatten the conical stream of liquid droplets; and directing air from the pair of auxiliary apertures to modify the air flowing from the fan control apertures, wherein each ledge improves axial alignment of the air flow external to its respective auxiliary aperture.

7. The method of claim 6, wherein air flowing into each auxiliary aperture is directed along directions parallel to the inner surface of the outer wall.

8. The method of claim 6, wherein the air discharged from each auxiliary aperture has a flow field that is generally symmetric about its respective auxiliary axis.

9. A spraying apparatus comprising:

the nozzle assembly of claim 1; and a spray gun platform releasably coupled to the nozzle assembly.

10. An air cap for a nozzle assembly of a spraying apparatus comprising:

an outer wall having opposed inner and outer surfaces;

a central aperture extending through the outer wall;

a pair of auxiliary apertures disposed on the outer wall, each auxiliary aperture aligned along a respective auxiliary axis, wherein an area of the inner surface of the outer wall adjacent to the auxiliary aperture is countersunk to define a ledge that is axially symmetric about the auxiliary axis; and a pair of diametrically opposed air horns protruding from the outer wall past the central aperture and defining respective air horn cavities, each air horn having an external wall and a fan control aperture extending along a fan control axis through the external wall to direct air from the air horn cavity against a conical stream of liquid droplets discharged from the central aperture, wherein each auxiliary axis is oriented transverse to a respective fan control axis.

11. A nozzle assembly for a spraying apparatus comprising:

an inner wall having opposed inner and outer surfaces, the inner surface defining a liquid passageway that extends longitudinally along a liquid axis and terminates in a liquid aperture;

an outer wall extending around the inner wall and having opposed inner and outer surfaces, wherein the outer surface of the inner wall and inner surface of the outer wall collectively define a first air passageway, the first air passageway terminating in an atomizing aperture adjacent the liquid aperture;

a pair of auxiliary apertures extending through the outer wall and in communication with the first air passageway, wherein each auxiliary aperture extends along an auxiliary axis and wherein an area of the inner surface of the outer wall adjacent to each auxiliary aperture is countersunk to define a ledge that is axially symmetric about its auxiliary axis, wherein the ledge is generally planar and aligned along a reference plane.

12. A method of aligning auxiliary air flow through the nozzle assembly of claim 11, the method comprising:

discharging a liquid from the liquid aperture in a conical stream of liquid droplets while directing air from the fan control apertures against the discharged liquid from opposing directions to flatten the conical stream of liquid droplets; and directing air from the pair of auxiliary apertures to modify the air flowing from the fan control apertures, wherein each ledge improves axial alignment of the air flow external to its respective auxiliary aperture.

13. The method of claim 12, wherein air flowing into each auxiliary aperture is directed along directions parallel to the inner surface of the outer wall.

14. The method of claim 12, wherein the air discharged from each auxiliary aperture has a flow field that is generally symmetric about its respective auxiliary axis.

15. A spraying apparatus comprising:

the nozzle assembly of claim 11; and a spray gun platform releasably coupled to the nozzle assembly.

16. The nozzle assembly of claim 1, wherein a shape of the ledge is at least partially curved where an entrance to the auxiliary apertures has an annular edge defined at the interface between a cylindrical side wall and the ledge, the annular edge having a corner radius of at least 1 percent the radius of the auxiliary aperture.

* * * * *